United States Patent [19]

Skeen

[11] 4,221,343

[45] Sep. 9, 1980

[54] VENTED DISC REFINER

[75] Inventor: Lawrence Skeen, Springfield, Ohio

[73] Assignee: The Bauer Bros. Co., Springfield, Ohio

[21] Appl. No.: 34,392

[22] Filed: Apr. 30, 1979

Related U.S. Application Data

[63] Continuation of Ser. No. 865,176, Dec. 28, 1977, abandoned, which is a continuation of Ser. No. 656,003, Feb. 6, 1976, abandoned.

[51] Int. Cl.[3] ..... B02C 7/11

[52] U.S. Cl. ..... 241/244; 241/251

[58] Field of Search ..... 241/244, 245, 250, 251

[56] References Cited

U.S. PATENT DOCUMENTS

| | | | |
|---|---|---|---|
| 2,561,043 | 7/1951 | Ayers | 241/245 X |
| 2,727,440 | 12/1955 | Jones et al. | 241/245 X |
| 3,589,629 | 6/1971 | Michel et al. | 241/251 |
| 3,709,443 | 1/1973 | Michel et al. | 241/251 X |
| 3,847,363 | 11/1974 | Reinhall | 241/245 |
| 4,059,237 | 11/1977 | Mannstrom | 241/245 X |

FOREIGN PATENT DOCUMENTS

| | | | |
|---|---|---|---|
| 2183928 | 12/1973 | France | 241/244 |

*Primary Examiner*—Howard N. Goldberg
*Attorney, Agent, or Firm*—Jerome F. Bloom

[57] ABSTRACT

A disc-type refiner wherein the means incorporating the refining surfaces are positioned in opposed, relatively adjacent, closely spaced relation and one thereof is formed to include at least one passageway through which steam created in the refining of material between the refining surfaces may be simply and quickly vented. A duct means is provided to receive and carry steam from the passageway to the exterior of the refiner housing, to facilitate use or disposal as and where desired. Means are included to control the amount of steam being vented and to maintain the venting arrangement on adjustment of the spacing between the refining surfaces. In the preferred embodiment illustrated, the invention features are incorporated in a double revolving disc refiner which, by reason of the improvements of the invention, may be operated under either atmospheric or pressurized conditions. In either case considerable benefit is reflected in the refining procedure and the quality of its end product.

15 Claims, 1 Drawing Figure

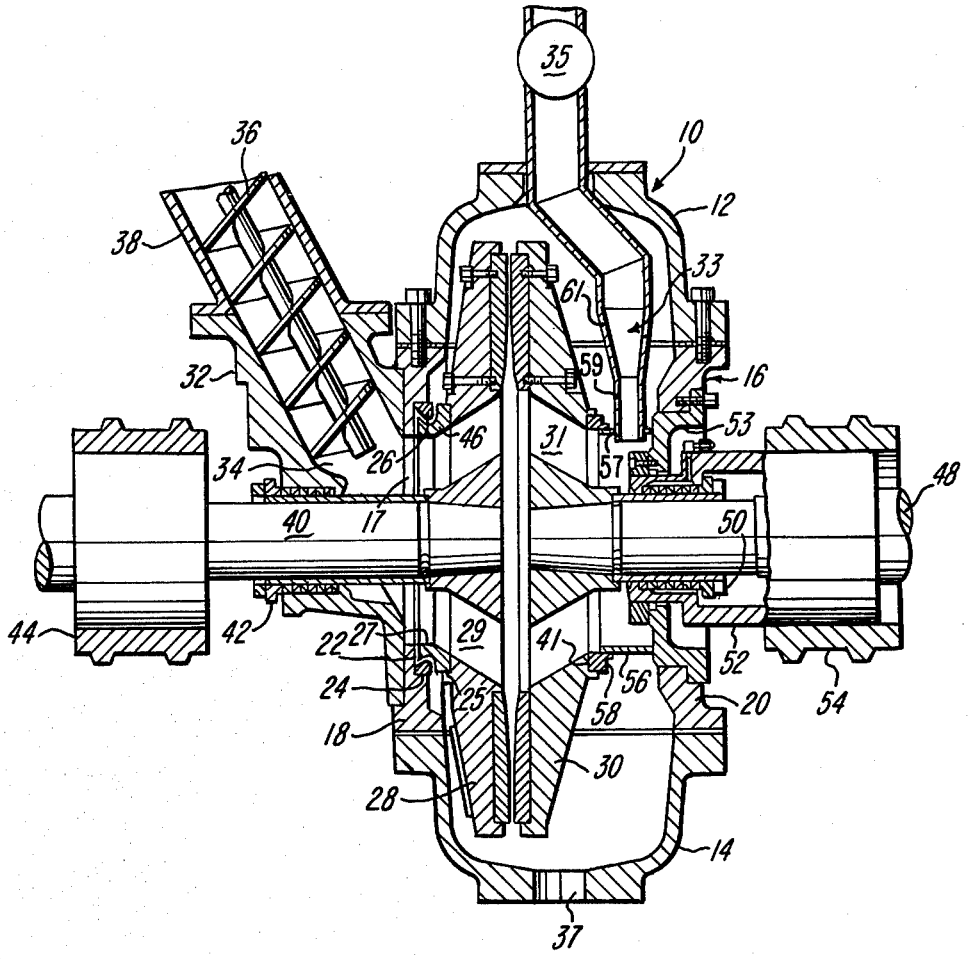
35
36
10
12
38
33
61
59
32
16
53
46
31
57
34
26
48
40
17
50
44
42
22
27
29
41
52
24
25
56
20
54
58
18
30
28
14
37

VENTED DISC REFINER

This is a continuation of applicant's pending application Ser. No. 865,176, now abandoned, filed Dec. 28, 1977, which was in turn a continuation of and co-pending with my previous application for United States Letters Patent Ser. No. 656,003, now abandoned, filed Feb. 6, 1976, entitled VENTED DISC REFINER, now abandoned.

BACKGROUND OF THE INVENTION

This invention relates to improvements in disc refiners providing for a simple, effective and controlled venting of steam produced in a disc refining operation. It is particularly advantageous in application to double revolving disc refiners and it will be so described by way of illustration. However, it is to be understood, and should become obvious, that the application of the invention is not so limited, and such is not intended.

The invention is directed to minimizing problems long evidenced in use of the prior art disc refiners. It has been found that substantially all the power applied in a disc refiner is converted to heat, developed as material is reduced between the relatively opposed refining surfaces of the refiner discs. A major portion of this heat functions to convert the moisture or liquid which is present to steam. Another portion of this heat is absorbed by the material being refined. The degree of heat developed is the source of the problems to a solution of which the present invention is directed. To understand the problem, consider if you will that in the operation thereof a disc refiner will generate heat capable of producing about a ton of steam at 212° F. per ton of wood or fibrous materials passed between the refiner discs when power is applied at the level of 60 H.P. days per ton of the material delivered in chip form at 15% consistency. Such a level of operation, or one with an even higher "effective" power input, is desirable to enable higher consistency refining and to obtain high quality products or, in the alternative, to enable the obtaining of the same quality products with a lesser power input. However, due to the considerable magnitude of steam developed, it has been found difficult if not impossible to operate a disc refiner under such conditions for any period of time without serious and undesirable consequences. As a matter of fact, experience has shown that when utilizing prior art disc refiner equipment one cannot afford normally to put more than about 50 H.P. days per ton into any disc refining operation and expect any degree of operating efficiency.

The nature of the operational problems solved by the present invention is exemplified as follows.

With an overabundance of steam, while part of the steam developed will exit with the refined material and in such case merely represent a loss of energy, the steam remaining in the disc refiner will, in conventional equipment, often times create a blowback condition. The import of such a condition is that the steam will move to interfere with the inflow to the refiner of the material to be refined. Of particular concern in the production of fibrous pulp is the fact that the interference of the steam will cause a nonuniform rate of material infeed and consequently a nonuniform quality of the end product issuing from the refiner. In many instances it has been found that the quantity of steam produced between the refining surfaces of a disc refiner in the course of its operation is so great that there is not only an interference with infeed but in fact a development of sufficient pressure in the eye of the refiner to completely block incoming material from passage to and between the refining surfaces of the refiner discs. This last can occur even though a positive displacement infeed device is provided in the feed passage leading to the inlet to the refiner. As a matter of fact, the restriction of the infeed passage by the positive displacement feed device can contribute to the buildup of the pressure created in the eye of the refiner. In any case, the foregoing presents a concise description of the problems in the prior art which can be alleviated by usage of embodiments of the present invention.

It has been the practice in the prior art to offset some of the problems above enumerated by the introduction of excess water with the material being refined, the purpose being to quench the steam. While this has helped to some degree, it is not only wasteful but it does cause an undesirable reduction in the consistency of the material being refined and a consequent reduction of the quality level of the resultant end product.

SUMMARY OF THE INVENTION

The primary objective and achievement of the present invention is to reduce the normally encountered buildup of excessive pressure in the "eye" of a refiner during a disc refining operation.

To illustrate a means and method by which this objective can be achieved, the present disclosure shows the invention as embodied in a double revolving disc refiner which is basically similar in construction to that of the refiner illustrated in U.S. Pat. No. 3,709,443. Such a refiner includes a pair of discs the refining surfaces of which are positioned in directly opposed, adjacent and relatively closely spaced relation, which discs are caused to rotate, one relative the other, as material to be refined is passed between their opposed refining surfaces. In accordance with the present invention, the one disc constituting the control end disc, in the example illustrated, is shown to include a plurality of vent holes or passageways communicating at one end with an area of the space between the discs known as the "eye" of the refiner, or adjacent thereto. The outermost ends of the vent holes or passageways, which are arranged to open from the backside of the control end disc, are commonly communicated with conduit means the nature and extent of which provides for steam received therein by way of said passageways to be directed to discharge exteriorly of the refiner housing. The conduit means is so coupled to the control end disc as to maintina its operative relation to the vent holes or passageways in the event the control end disc may be moved to or from the opposite (feed end) disc to produce a required spacing between the disc refining surfaces.

Particular features to be noted in the illustrated embodiment of the invention include the provision of vent holes or passageways the axial length of each of which is relatively short since it extends directly through the body of the control end disc in an essentially straight line path, from one face of the disc to the other. In connection with a feed end disc such as illustrated, the exemplary embodiment shows an arrangement wherein the feed passages in the feed end disc and the vent holes or passageways in the control end disc commonly communicate with the same general area of the space between the discs, adjacent their centers.

By virtue of the particular nature and positioning of the vent holes or passageways in the control end disc as here provided and their continuing common communication with the conduit means as indicated, excess steam produced in the course of a disc refining procedure is continuously and effectively channelled from between the discs and to points exterior to the refiner housing. Means provided to regulate this transfer of steam insure optimal control of the environment within the refiner and in the area between the disc refining surfaces. By virtue of this arrangement, the invention has produced unobvious results in its application.

One important benefit of the invention is that it enables disc refiners to operate on slurries having a higher consistency of solids and with an "effective" power input at a much higher level, even up to 70 to 90 H.P. days/ton of the material delivered, with proportional increase in the quality of the end product. By the same token it obviates the need for applying excess water to quench steam as would otherwise be required. The end result, in any case, is to reduce the pressure developed in the eye of the refiner and to enable the refiner to produce the same quality pulp at lower H.P. days/ton than was previously possible. Derivative results include more uniform infeed of material to be refined and an elimination of overload and stoppage of a positive displacement feeder, if the same should be employed. Where the refiner is to operate under pressurized conditions, the invention may enable the elimination of a cross screw such as is normally required to insure positive delivery of material to the refiner. Of course, inherent in the operation of a disc refiner modified in accordance with the invention is the conservation of energy.

While the invention will be described as incorporated in a double revolving disc refiner, it should be obvious therefrom that similar principles may be employed to modify a single disc refiner to embody the features of the present invention.

It is accordingly a primary object of the invention to provide improvements in disc refiners rendering them more efficient and satisfactory in use, adaptable to a wider variety of applications and unlikely to malfunction.

A further object of the invention is to provide improvements in disc refiners enabling them to operate with delivered materials being maintained at a higher consistency of solids.

A further object of the invention is to provide improvements in a disc refiner obviating the problems normally produced by the production of steam in the refining procedure.

Another object of the invention is to provide improvements in disc refiners enabling such refiners to produce a quality end product at lower H.P days/ton than was previously possible.

An additional object of the invention is to operate a disc refiner in a manner to conserve energy and to produce higher quality end products by obviating the need for excess water to quench steam in the disc refining operation.

A further object of the invention is to provide a disc refiner with improvements possessing the advantageous features, the inherent meritorious characteristics and the means and mode of use herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the accompanying drawing, wherein one but not necessarily the only form of embodiment of the invention is illustrated, FIG. 1 is a generally diagrammatic illustration, in cross section, of a double revolving disc refiner embodying features of the present invention.

The refiner illustrated in the accompanying drawings to exemplify an embodiment of the present invention is a modified version of that illustrated in the previously mentioned U.S. Pat. No. 3,709,443. As may be seen, the refiner is a double revolving disc refiner, both of the refiner discs being arranged to rotate, with each moving relative the other.

As will be self-evident only so much of the refiner detail is here illustrated or described as may be necessary for an understanding of the present invention. The nature and character of the parts not shown or described in detail obviously may be seen with reference to the aforementioned U.S. Letters Patent, or they are conventional and will be well known and understood by those versed in the art.

The refiner shown in the drawings comprises a pair of refiner discs 28 and 30 housed within and free and clear of the interior surface of the refiner case 10. The case 10 is comprised of a vertically oriented tubular waist portion 16, capped to one end by a dome-shaped top portion 12 and to the other vertical extremity by a dome-shaped bottom portion 14 which is relatively inverted. As seen in the drawing, in transverse section, the relatively remote wall portions 18 and 20 of the waist portion 16, in an axial sense, are oriented in generally vertical planes. Also disc 28 is so mounted that its back surface is in immediately adjacent, closely spaced relation to the interior surface of the wall portion 18 while its operating surface is in a plane parallel to said wall portion.

The refiner disc 28 has a central aperture accommodating one end of a drive shaft 40 to which it is fixed. The shaft 40 is directed outwardly of the case 10 through the center of an inlet aperture 17, provided in the wall portion 18 immediately to the rear (or to the left as illustrated) of the disc 28.

The interior wall surface of the wall portion 18 includes a recessed shoulder 22 which rims the aperture 17. The outer peripheral limit of the shoulder 22 is bounded by a shallow cylindrical wall surface 24. A similar shallow cylindrical, axially directed, wall surface 25, aligned with and in end spaced relation to the wall surface 24, is defined by an annular ring-like projection from the rear face of the disc 28. Seated to the rear surface of the disc 28 and against the wall surface 25 is the base portion of an axially projected ring element 46. The projected end of the ring 46 provides an annular vertically oriented surface disposing in an almost touching and parallel relation to the shoulder 22.

The configuration of the innermost peripheral surface of the ring 46 is such that its projected end portion 27 has a cylindrical contour adapted to form a direct axial extension of the wall surface bounding the aperture 17. Following the surface portion 27, in the direction of the disc 28, the remainder of the inner peripheral surface of the ring 46 is provided with a conically expanding configuration.

The line defining the expanded extremity of the inner peripheral surface of the ring 46 is in peripherally rimming relation to the entrance ends of a plurality of infeed passages 29 formed in the body of the disc 28. The entrance ends of the passages 29 are arranged in a circularly spaced relation, in concentric, adjacent, radially spaced, relation to the drive shaft 40. The passages 29 are straight line passages formed to extend to the operating face of the disc 28 in a conically divergent pattern, clearly seen from their generally diagrammatic showing in the drawing. The discharge ends of the passages 29 open from the operating face of the disc 28 at locations immediately adjacent the inner peripheral limit of a series of conventional, circularly arranged, refiner plates fixed to provide the disc with its refining surface.

The outer peripheral surface of the ring element 46 is formed with a circumferential groove nesting a complementarily shaped male formed projection provided on a ring-like element 26 fixed in connection with the wall surface 24 bounding the shoulder 22. By virtue of its closely spaced relation to the adjacent surface of the shoulder 22 and the ring element 26, the ring element 46 provides, on rotation thereof with the disc 28, a seal. This seal prevents material fed through the inlet aperture 17 from bypassing the disc 28 in a manner believed obvious and well known in the art.

A tubular wall structure forming a feed spout 32 defines a material feed passage 34 directed downwardly to the inlet aperture 17, in a vertically inclined path. The lowermost end of the wall structure forming the feed spout 32 embodies an external flange which is abutted with and welded to a recessed shoulder formed in the outer surface of the wall portion 18 of the case 10, in immediately rimming relation to the aperture 17.

In the vertical plane of its discharge end, the diameter of the feed passage 34 is slightly less than that of the inlet aperture 17. By reason of the noted difference in dimension and the centered alignment of the lower end opening of the feed passage 34 with respect to the upper portion of the inlet aperture 17, the flanged lower end portion of the wall structure of the feed spout will overlap the lowermost portion of the inlet aperture 17. This arrangement is provided to enable material directed through the inlet aperture to more expeditiously flow to and through the infeed passages 29 in the disc 28.

As the drive shaft 40 extends outwardly of the case 10 through the center of the aperture 17 it is first directed through the lower end portion of the feed passage 34 and then through a packing gland and follower assembly 42 defining a seal thereabout as it projects through an opening in the wall portion of the feed spout 32 located in an adjacent vertically spaced relation to its lowermost end portion.

Within the case 10, the refiner plates in connection with the outer peripheral area of the disc 28 are in immediately opposed, closely adjacent, relation to similar refining plates fixed to the adjacent operating surface of the disc 30. In accordance with the present invention, the embodiment thereof in the disc 30 here illustrated provides that the disc has a plurality of straight line passageways defining vent holes which open at one end from the body of the disc 30, from an annular portion of its operating face, to the space between it and that of the disc 28, at locations immediately inward of the inner radial limit of the disc refining plates. This annular portion of the operating face of the disc 30 is, in the example illustrated, in direct and axial alignment with an annular surface portion of the operating face of the disc 28 occupied by the circularly spaced discharge ends of the infeed passages 29. As shown in cross section in the drawing, the vent holes 31 extend from the operating face of the disc 30 to its rear or opposite face in a conically convergent pattern. This provides that the vent holes open from the opposite face of the disc 30 in concentric, adjacent, and closely spaced relation to an aperture at the disc center accommodating one end of a drive shaft 48 to which the disc is suitably fixed.

In the mounting of the refiner disc 30 the drive shaft 48 is placed in direct coaxial alignment and in end spaced relation to the shaft 40, as may be seen from the accompanying drawing. The shaft 48 is thus arranged to extend outwardly from the case 10 and through the center of an appropriate aperture provided in the wall surface portion 20. This aperture in the wall surface portion 20 is partially capped by an annular cup-shaped plate segment 53 including an external flange at the mouth thereof by means of which the plate segment is seated to and connected with the wall portion 20, as may be clearly seen with reference to the accompanying drawing. Suitable with reference to the accompanying drawing. Suitable ring-shaped bearing means provided to line the inner periphery of the plate segment 53 accommodates, in bearing relation thereto and for axial adjustment therein, one end of a tubular cartridge 52. The cartridge 52 embodies therein, in a conventional manner, a packing gland and follower assembly 50 accommodating the projection therethrough of the shaft 48 as it extends in a sense outwardly of the case 10. As may be seen, the external diameter of the cartridge 52 is enlarged outwardly of the plate segment 53 where the cartridge is abutted to a shoulder provided by an enlargement of the drive shaft 48. Bearings (not shown) provide for the rotation of the shaft 48 within the cartridge 52 and the cartridge is suitably fixed to the shaft for movement therewith. Thus the cartridge 52 is contained for movement with the disc 30 and the shaft 48 in the event the latter are axially adjusted to achieve a desired spacing between the refiner plates positioned in adjacent closely spaced relation by their connection with and mount on the discs 28 and 30. The adjusting mechanism may be of any suitable character well known to those versed in the art. Since it forms no part of the present invention, it is neither shown nor further described.

Attention is directed to the fact that the drawing illustrates bearing housings 44 and 54 respectively for the shaft 40 and the shaft 48 and cartridge 52. Such bearing housings will be provided on the conventional refiner base to which the refiner illustrated will be conventionally mounted together with the drive motors for the shafts 40 and 48. Again, since such details are unessential to an understanding of the present invention, they as well as the other details of similar character are neither shown nor particularly described. Such details as this, and details of a mechanism for axially adjusting shaft 48, are exemplified in the aforementioned U.S. Pat. No. 3,709,443.

Referring further to details contributing to the embodiment of the present invention, attention is directed to the fact that the openings of the vent holes or passageways 31 from the rearmost face of the disc 30 are arranged in a closely and circularly spaced annular arrangement, concentric to and immediately about the hub portion of the disc 30 through which extends the shaft 48. The outer peripheries of the rearmost openings are immediately rimmed by a recessed shoulder 41 formed in the rearmost face of the disc 30. The shoulder 41 provides a seat for a suitably fixed ring 58 which is axially projected in the direction of the wall surface portion 20 of the case 10.

The projected extremity of the ring 58 is telescoped about and accommodates therein one end of a co-axial tubular sleeve structure 56 the opposite end of which is suitably fixed by a sealed engagement thereof with the innermost face of the closure plate segment 53. The relation of the inner surface of the ring 58 to the outer surface of the sleeve 56 is such that on a rotation of the disc 30 a continuing seal is provided therebetween. The seal is of a nature to accommodate an axial movement of the shaft 48, to provide for such fine adjustment of the spacing between the surfaces of the relatively opposed refining plates on the discs 28 and 30 as may be desired.

The sleeve structure 56 is provided with an opening 57 in which is fixed one end of an elliptical configured tubular duct segment 59 defining one end portion of a duct structure 33. The latter provides a continuing passage one end of which opens to the interior of the sleeve 56 as described and the opposite end of which is located exterior to the case 10. In the case of the example illustrated, a segment 61 of the duct structure 33 which immediately follows the segment 59 is formed to provide a generally conical expansion of the duct passage to achieve an enlarged cross section thereof which is generally uniformly continued in following segments of the duct structure as it is extended through an aperture provided in the top of the case 10, at which point a seal is provided between the case 10 and the duct structure 33. For purposes of illustration the duct structure is merely shown to extend to some point exterior to the case 10. The duct structure may be interconnected to a heat recovery system or any other apparatus provided in a refining installation, to deliver steam thereto as and when required. Incorporated in the duct structure 33 is a suitable valve 35 which may be selectively adjusted to determine the amount of steam that may be permitted to pass from the case 10 by way of the duct 33. While the opening 57 is shown to be positioned at the top portion of the sleeve 56, this is merely for convenience of illustration. It will be obvious to those versed in the art that the opening 57 may be otherwise located.

In the case illustrated the feed spout 32 and a tubular extension 38 thereof, by means of which the feed spout connects to a supply of material to be refined, incorporates in its feed passage a screw type positive displacement feeder device 36. While this device is illustrated, under certain conditions and applications such as in the use of the disc refiner as a pressurized refiner the feeder 36 may in accordance with the invention be eliminated.

The aforementioned embodiment particularly described and diagrammatically and schematically illustrated will function in a refining procedure, as follows.

In the operation of the disc refiner illustrated the invention improvements function very simply and very effectively. As the material to be refined is directed inwardly of the feed spout 32 utilizing the screw feeder 36 and operating the refiner as a free discharge refiner, the material delivered by the screw will drop from the lower end thereof into the relatively clear discharge end portion of the passage 34. Under the influence of the material further delivered, this material to be refined will be caused to move smoothly and freely to and through the inlet aperture 17 and, by way of the ring 46, into and through the flow passages 29 of the rotating disc 28. From the flow passages 29, the material to be refined will enter the space between the operating faces of the relatively rotating discs 28 and 30 immediately inward of the refining throat at the entrance ends of the relatively opposed refining surfaces provided on the discs. Due to the inclination of the flow passages 29, the material to be refined will tend to move, immediately, between the refining surfaces and radially outwardly thereof, in the process of which to have their fibers separated, one from the other. As is well known, in view of the slurry form of the material as generally delivered in a pulp refining operation, steam will be developed as the power applied in the disc refining procedure is converted to heat by reason of the refining operation. In accordance with the present invention, rather than excess steam building up between the discs and in the eye of the refiner, the vent holes provided by the passageways 31 will provide paths for portions of the steam to pass directly through the body of the disc 30 and into the sleeve 56, to exit by way of the duct 33. The steam may be permitted to exit either freely or to a degree permitted by the setting of the valve 35, the latter being adjustable to provide a controlled passage for steam to move from the duct 33 to a place of use. It will be obvious, of course, that this steam, which is so quickly and easily vented, can be channelled by suitable plumbing into a presteamer or digester ahead of the refiner. This will most effectively reduce or eliminate the requirement for fresh steam that would normally be required and applied in a refiner installation absent the use of the improvements of the present invention. Another benefit of the venting of steam as here provided is that the reduction in pressure results in less steam being discharged with the refined material. Consequently there is a significant savings in energy which can be utilized elsewhere.

Attention is directed to the fact that due to the centrifugal force developed in the refining procedure, any particles which might tend to move from between the disc operating surfaces and into the passageways or vent holes 31 would be drawn therefrom under the influence of the centrifugal force and induced to move radially outward between the refining plates on the counter-rotating operating surfaces of the discs 28 and 30.

A feature of significance in the particular embodiment illustrated is that manufacturing costs can be saved by the arrangement of the passageways 31 in the disc 30 to be essentially the same as the arrangement of the infeed passages 29 in the disc 28. One can then use the same disc as both an infeed disc such as the disc 28 and a control end disc such as the disc 30. Of course, while this is desirable, this arrangement is not required to utilize the benefits of the invention.

Under the circumstances, by reason of the very simple venting arrangement, whereby there is a natural venting from the eye of the refiner or adjacent thereto, blowback conditions are virtually eliminated. This means that with a free discharge refiner one can have a uniform rate of feed, determined by the operation of the feeder screw 36. The flow of material will in any case be smoothly directed to the throat of the refiner and move radially outward therefrom under the influence of centrifugal force. In its radial outward movement the material will be refined in accordance with the reduction set into the refiner by virtue of the nature of the refining surfaces of the refiner plates and their spacing. The inflowing material can be readily controlled to permit the steam developed in the refining procedure to be directed inwardly towards the eye of the refiner and quickly vented to the degree desired, to be directed clear of the refiner case by way of the duct 33. The regulation of the steam permitted to exit will be such to insure the required conditioning of the material during the refiner operation.

In the instance illustrated there is a showing, of a generally diagrammatic nature, evidencing an outlet 37 from the case 10 through which the refined material issuing from the outer periphery of the refiner discs as they counter-rotate may drop in a free discharge. Of course the nature and placement of the discharge opening will depend on the application of the refiner.

As noted previously, in certain instances where the refiner is operated as a pressurized refiner, being appropriately sealed in the well known manner, the ability to control the steam pressure as provided by the invention may eliminate the need for the conventional cross screw feeder which is normally employed in delivering material to a pressurized refiner.

To summarize the benefits of the invention, since the invention eliminates the need for excess water to quench steam that is normally produced in a disc refiner, one can operate the refiner very effectively on materials delivered which have a higher consistency of solids than previously contemplated. A consequence of the invention in the alternative is that on the one hand one can apply a greater power input to a disc refiner than was previously possible without the usual operational difficulties and with correspondingly increasing quality of the end products while on the other hand one can more effectively utilize a lower power input to achieve a higher quality end product than was previously possible.

An obvious additional accomplishment of the invention is that it enables a more uniform and controlled feed of the material to be refined and consequently it insures a higher quality end product. In the process there is a conservation of energy. Obviously, moreover, the invention eliminates overload and stoppage conditions which would normally interfere with a proper infeed of material to be refined. Much care has been taken to avoid introduction or showing of those details of a refiner installation which are not material to an understanding of the invention and under such circumstances, it is believed that the invention, its objectives and its achievements should be quite clear from the foregoing description of an exemplary embodiment.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

For the record additional art considered pertinent to this case but not specifically illustrative of the particular features of novelty of the present invention include the following:

| COUNTRY | NO. | NAME | DATE |
|---|---|---|---|
| U.S.A. | 2,561,043 | J. W. Ayers | July 17, 1951 |
| U.S.A. | 2,727,440 | D. E. Jones et al | Dec. 20, 1955 |
| U.S.A. | 3,589,629 | D. Michel et al | June 29, 1971 |
| U.S.A. | 3,709,443 | D. Michel et al | Jan. 29, 1973 |
| U.S.A. | 3,847,363 | Rolf Reinhall | Nov. 12, 1974 |
| France | 2.183.928 | Projekt | Dec. 1973 |

I claim:

1. A refiner, including a housing having an inlet thereto and an outlet therefrom, at least one pair of refining discs within said housing, each said disc having an operating face embodying means defining thereon a refining surface, said one pair of discs being arranged with their refining surfaces positioned in an opposed, adjacent and closely spaced relation to receive and refine therebetween, on rotation of one relative the other, the material to be refined, which is introduced to said housing by way of said inlet, which material subsequent to its refining is directed from said housing by way of said outlet, and means mounting said one pair of discs providing for at least one thereof to rotate relative the other, characterized in that a first rotatable one of said pair of discs has therein at least one passageway which extends therethrough and has one end in open communication with the space between the adjacent faces of said discs and its opposite end in open communication with means in said housing which forms a direct extension of said one passageway and provides therewith a continuous duct connected with another outlet from said housing which is remote from said inlet, said duct being constructed and arranged to extend to the exterior of said housing and to pass steam created in the refining of material between the refining surfaces of said one pair of discs directly to said housing exterior and preclude the steam passed thereby from moving to the vicinity of said inlet or reentering the environment of said discs interiorly of said housing.

2. A disc refiner as in claim 1 wherein said extension includes, in connection therewith, means to control the amount of steam which is directed through said duct and from said housing.

3. A disc refiner as in claim 1 wherein said one end of said one passageway which opens to and communicates with the space between said discs opens to that portion of said space constituting, substantially, the "eye" of the refiner.

4. A disc refiner as in claim 1 wherein the other disc of said one pair of discs embodies an infeed passage receiving and passing the material to be refined to said space between said discs and to said opposed refining surfaces in a continuing flow.

5. A disc refiner as in claim 1 wherein each one of said pair of discs is mounted for rotation within said housing and for rotation relative the other, and said passageway has the said one end thereof more widely spaced from the central axis of said first rotatable one of said discs than the said opposite end thereof.

6. A disc refiner as in claim 1 wherein said disc mounting means include a pair of rotatable shafts, each disc of said one pair of discs is mounted on one end of one of said shafts and said shafts project from the respective discs in opposite directions and outwardly of remote sides said housing through apertures in said housing rimmed by sealing means, each of which sealing means provides a bearing surface for the related shaft, and said first rotatable one of said pair of discs includes a plurality of openings defining a plurality of said passageways and said passageways are commonly connected to open into said means forming a direct extension of said one passageway.

7. A disc refiner as in claim 6 wherein said plurality of passageways as provided in said first rotatable one of said pair of discs are arranged in adjacent surrounding relation to the shaft to which said first rotatable one of said pair of discs is mounted and said plurality of passageways are arranged to converge as they extend from said space between said discs to said extension.

8. A disc refiner as in claim 7 characterized in that the other disc of said one pair of discs is also formed to include a plurality of passageways which lead from said inlet to said space between said one pair of discs to provide for the material to be refined to move therethrough in a diverging flow pattern to direct the material to and between said opposed refining surfaces.

9. A disc refiner as in claim 8 characterized in that said passageways in said discs commonly open at one end to generally the same area of said space between said discs.

10. A disc refiner as in claim 1 wherein said means which forms a direct extension of said passageway is interconnected to said first rotatable one of said discs to accommodate its relative movement while maintaining a seal in the connection therebetween to insure a contained directed flow of the steam created between the refining surfaces of said one pair of discs, to and through said passageway and said extension forming said duct and directly to an area exterior to said housing, and one of said passageway and its said extension embodies means for controlling said flow of steam.

11. A refiner according to claim 1 wherein said one passageway in said one of said one pair of discs is an aperture forming a flow path which is angularly inclined to the central axis of said first rotatable one of said discs in which it is formed and inwardly to said extension, a sealed connection being provided between said first rotatable one of said discs and said extension which accommodates the rotation of said first rotatable one of said discs and maintains a relatively sealed flow path for vented steam which is continued from said space between said one pair of discs to a steam outlet defined in the wall of said housing at its exterior.

12. A disc refiner according to claim 11 wherein each of said one pair of discs includes a plurality of apertures each defining a passageway and the plurality of apertures in each said disc forms a pattern conically divergent from the face of the disc remote from its operating face to said space between said discs at a location thereof constituting the eye of said refiner and said extension has the form of a single flow channel opening by way of said steam outlet to the exterior of said housing.

13. A disc refiner according to claim 12 wherein said discs are constructed to be substantially identical and to be interchangeable one with the other.

14. A disc refiner according to claim 1 wherein a sleeve is fixed to position coaxially with said first rotatable one of said one pair of discs and to have one end thereof in a bearing relation to means in connection with said first rotatable one of said one pair of discs, which defines therewith a seal, and to have its opposite end connected to and capped by a portion of the wall of said housing and said one passageway is arranged to discharge the steam, directly to and through the interior of said sleeve, which forms a part of said extension and accommodates the rotation of said first rotatable one of said one pair of discs as it passes steam to said extension.

15. A disc refiner according to claim 14 wherein said first rotatable one of said one pair of discs has a plurlity of said passageways arranged to converge to said extension and to connect thereto in an arrangement providing that all thereof commonly discharge to said extension and said discs are so arranged as to be effective, on rotation thereof, to inhibit the material reaching the space between said one pair of said discs of said refiner from passing therethrough and exiting from said housing with the steam moving to and through said passageways.

* * * * *

UNITED STATES PATENT AND TRADEMARK OFFICE

CERTIFICATE OF CORRECTION

PATENT NO. : 4,221,343

DATED : September 9, 1980

INVENTOR(S) : Lawrence Skeen

It is certified that error appears in the above-identified patent and that said Letters Patent are hereby corrected as shown below:

Col. 2, line 51, "tina" is corrected to read -- tain --.

Col. 3, line 52, a period is inserted following "P".

Col. 6, lines 19-20, delete "Suitable with reference to the accompanying drawing."

Col. 12, line 31 (Claim 15, line 2) "plurlity" is corrected to read -- plurality --.

Signed and Sealed this

*Twenty-third* Day of *December 1980*

[SEAL]

*Attest:*

SIDNEY A. DIAMOND

*Attesting Officer*

*Commissioner of Patents and Trademarks*